US005955824A

United States Patent [19]

Saito et al.

[11] Patent Number: 5,955,824

[45] Date of Patent: Sep. 21, 1999

[54] REDUCED SIZE ELECTRO-ACOUSTIC TRANSDUCER WITH IMPROVED TERMINAL

[75] Inventors: Shuho Saito, Toyama; Kazuaki Yamamoto, Takaoka; Hiroyuki Inami, Toyama-ken, all of Japan

[73] Assignee: Murata Manufacturing Co., Ltd., Kyoto, Japan

[21] Appl. No.: 08/901,598

[22] Filed: Jul. 28, 1997

[30] Foreign Application Priority Data

Aug. 13, 1996 [JP] Japan ..... 8-213890
Sep. 9, 1996 [JP] Japan ..... 8-238075

[51] Int. Cl.[6] ..... H04R 17/00; H04R 1/00

[52] U.S. Cl. ..... 310/348; 310/324

[58] Field of Search ..... 310/321, 324, 310/348

[56] References Cited

U.S. PATENT DOCUMENTS

| | | | |
|---|---|---|---|
| 3,700,938 | 10/1972 | Bryant | 310/324 |
| 3,849,679 | 11/1974 | Massa | 310/324 |
| 3,855,693 | 12/1974 | Umbaugh | 29/626 |
| 4,006,371 | 2/1977 | Quirke | 310/324 |
| 4,092,463 | 5/1978 | Wurmb et al. | 429/105 |
| 4,439,640 | 3/1984 | Takaya | 310/324 |
| 5,486,682 | 1/1996 | Rysemus | 219/544 |
| 5,594,292 | 1/1997 | Takeuchi et al. | 310/324 |
| 5,770,915 | 6/1998 | Sumita et al. | 310/348 |
| 5,801,474 | 9/1998 | Sakairi | 310/313 R |

FOREIGN PATENT DOCUMENTS

| | | | |
|---|---|---|---|
| 5-111085 | 4/1993 | Japan | H04R 1/10 |
| 7-203590 | 8/1994 | Japan | H04R 17/00 |

*Primary Examiner*—Thomas M. Dougherty
*Attorney, Agent, or Firm*—Graham & James LLP

[57] ABSTRACT

A piezoelectric electro-acoustic transducer eliminates a negative influence caused by metal terminals upon the sound pressure and resonant frequency characteristics even when size and thickness reduction of the transducer are made. The transducer includes a piezoelectric diaphragm which includes a piezoelectric ceramic plate and a metal plate stored in a casing. The transducer also includes metal terminals in contact with the piezoelectric diaphragm and extending to the outside of the casing. The modulus of elasticity X of one metal terminal is specifically determined to be within a range defined by:

$$\frac{b \times h^3 \times E}{4 \times L^3} \leq 100\ (N/m),$$

where E ($N/m^3$) is the Young's modulus of one metal terminal in contact with a piezoelectric element, b (mm) is the width of part of the metal terminal extending from the inside of the casing to the outside thereof, h (mm) is the thickness of the metal terminal, and L (mm) is the length of the metal terminal.

17 Claims, 4 Drawing Sheets

REDUCED SIZE ELECTRO-ACOUSTIC TRANSDUCER WITH IMPROVED TERMINAL

BACKGROUND OF THE INVENTION

1. Field of the Invention

The present invention relates generally to piezoelectric devices, and more particularly to piezoelectric electro-acoustic transducers for use in piezoelectric sounders, piezoelectric telephone receivers and other devices. The invention also relates to a piezoelectric electro-acoustic transducer having an improved terminal for interconnection with a piezoelectric diaphragm.

2. Description of the Prior Art

Conventionally, various types of electro-acoustic transducers utilizing the piezoelectric effect are known. For example, Published Unexamined Japanese Patent Application (PUJPA) No. 5-111085 discloses a ceramic receiver which includes a piezoelectric diaphragm that consists of a lamination of a metal plate and a piezoelectric element on the surface thereof and that is contained inside a casing, wherein a metal terminal is connected at one end thereof to the piezoelectric diaphragm plate and the other end of the metal terminal extends to outside of the casing. Interconnection of the metal terminals to the piezoelectric diaphragm is done by soldering or spring-contact techniques.

A piezoelectric telephone receiver is disclosed in PUJPA No. 7-203590, wherein a piezoelectric diaphragm consists of a metal plate and a piezoelectric ceramic plate laminated on one surface thereof, and is contained inside a casing while associated lead wires are coupled to the piezoelectric diaphragm such that the lead wires extend to outside of the casing.

As disclosed in PUJPA Nos. 5-111085 and 7-203590, the prior art piezoelectric electro-acoustic transducers have been structured such that the piezoelectric diaphragm is supported inside the casing while the piezoelectric diaphragm is connected to one end of a lead wire or a metal terminal with the lead wire or metal terminal being elongated to extend outside of the casing.

Incidentally, in the recent years, overall size and thickness reduction are becoming important more and more in the manufacture of various types of products. This is also the major trend of electronic parts or components which are to be assembled or provided in various electronic products. Accordingly, overall size and thickness reduction are also highly demanded for the manufacture of piezoelectric electro-acoustic transducers.

However, in piezoelectric electro-acoustic transducers having the structure for storing and holding the piezoelectric diaphragm within the casing, where an attempt is made to accomplish size and thickness reduction, a required gap space will likewise decrease in size between the piezoelectric diaphragm and associated surrounding portions of the casing. This can adversely increase the risk of having an electrode takeout structure, consisting of lead wires and/or metal terminals, contact the inner wall of the casing, which prevents effective vibrations of the piezoelectric diaphragm. As a result of such contact, the sound pressure is decreased, and the resonance frequency increases beyond a desired resonance frequency, thereby rendering it impossible to obtain any desired transducer characteristics.

SUMMARY OF THE INVENTION

To overcome the problems with the prior art discussed above, the preferred embodiments of the invention provide an improved a piezoelectric electro-acoustic transducer having an improved structure of suppressing or eliminating a negative influence on the sound pressure and resonant frequency characteristics caused by an electrode takeout device even though the electro-acoustic transducer having a substantially reduced size and thickness.

The preferred embodiments of the present invention provide a piezoelectric electro-acoustic transducer which includes a piezoelectric diaphragm having a piezoelectric ceramic plate and a metallic plate. In at least one preferred embodiment, the vibration plate preferably has a thickness of about 100 $\mu$m or less whereas the metallic plate preferably has a thickness of about 100 $\mu$m or less. The transducer also includes a casing for supporting and storing the piezoelectric diaphragm. The piezoelectric diaphragm has an electrode disposed on a surface opposite to at least the metallic plate while metal terminals are arranged to be in contact with the metallic plate of the piezoelectric diaphragm and the electrode, respectively.

One significant feature of the transducer lies in that the modulus of elasticity X is specifically determined to fall within a desired range given as:

$$\frac{b \times h^3 \times E}{4 \times L^3} \leq 100\ (N/m),$$

where, E ($N/m^3$) is the Young's modulus of the metal terminal disposed in contact with the electrode on the piezoelectric ceramic plate, b (mm) is the width of a portion of the metal terminal extending from the inside of the casing to the outside thereof, h (mm) is the thickness of the metal terminal, and L (mm) is the length of the metal terminal.

The advantages of the preferred embodiments of the present invention have been achieved as a result of diligent research of piezoelectric electro-acoustic transducers which have a piezoelectric diaphragm contained within a casing, which when subjected to a decrease in size and thickness, the resulting sound pressure and resonance frequency characteristics are affected by the electrode takeout device. As a result of the diligent research, it was discovered that the advantages of the preferred embodiments of the present invention are achieved by improvement of the metal terminal used as the electrode takeout device.

More specifically, the piezoelectric electro-acoustic transducer of the preferred embodiments of the present invention includes a metal terminal comprised of a specific component part which achieves the above criteria in physical nature and in size; in particular, it has been discovered that such metal terminal may be used as the metal terminal to be disposed in contact with the electrode provided on a piezoelectric ceramic plate of the piezoelectric diaphragm.

These and other elements, features, and advantages of the preferred embodiments of the present invention will be apparent from the following detailed description of the preferred embodiments of the present invention, as illustrated in the accompanying drawings.

DETAILED DESCRIPTION OF PREFERRED EMBODIMENTS

Figure 1:
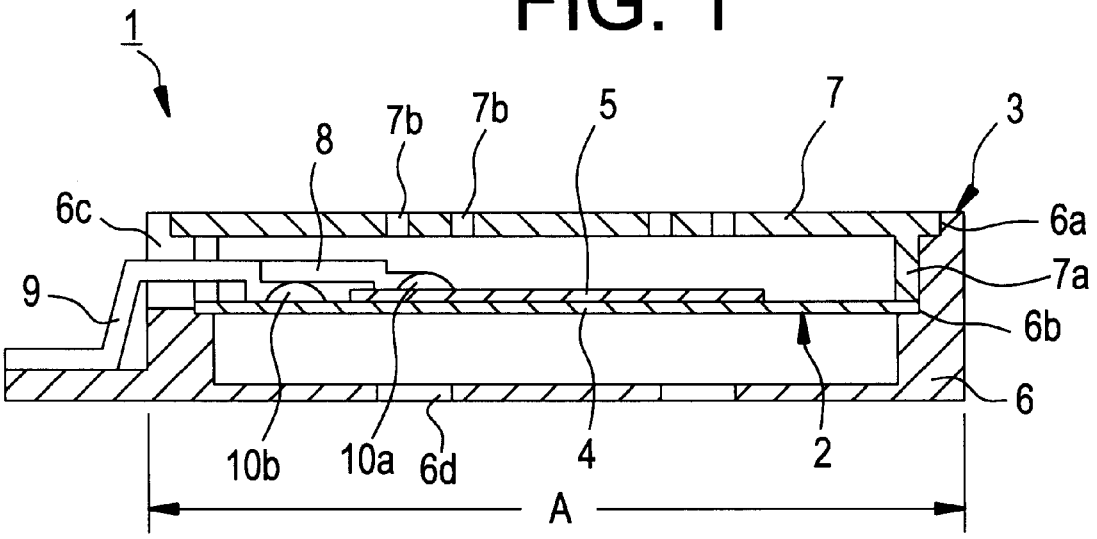
FIG. 1 is a longitudinal cross-sectional view of a piezoelectric electro-acoustic transducer in accordance with one preferred embodiment of the present invention.

Referring to FIG. 1, a piezoelectric electro-acoustic transducer device in accordance with one preferred embodiment of the invention is generally designated by reference numeral 1. The piezoelectric electro-acoustic transducer 1 includes a piezoelectric diaphragm 2, and a casing 3 which holds or stores therein the piezoelectric diaphragm 2.

The piezoelectric diaphragm 2 is preferably constructed from a disk-like metal plate 4 and a disk-like piezoelectric element 5 which preferably has a diameter less than that of the metal plate 4 and is laminated by adhesion on the upper surface of the metal plate 4. The metal plate 4 may be made of a chosen metal or metal alloy, including stainless steel, brass, Ni-alloy and other suitable materials. In one preferred embodiment, the metal plate 4 preferably measures about 100 $\mu$m or less in thickness. The reason for using such a thin metal plate is that with metal terminals satisfying specific criteria to be described later, it will make it impossible or at least difficult for piezoelectric electro-acoustic transducers otherwise using a metal plate having a thickness of 100 $\mu$m or greater to achieve any intended advantages of decreasing the sound pressure and suppressing variations of resonance frequency characteristics.

The piezoelectric element 5 includes a structure in which an electrode (not shown) is formed on the upper surface of a disk-like piezoelectric ceramic plate. This piezoelectric ceramic plate may be made of either suitable piezoelectric ceramics such as lead zirconate titanate-based piezoelectric ceramics or piezoelectric single-crystals such as quartz crystal. With regard to the piezoelectric ceramic plate, a plate which has a thickness of about 100 $\mu$m or less is preferably used. The reason for this is that if the thickness is greater than 100 $\mu$m then it will no longer be possible to accomplish sufficient suppression of a decrease in sound pressure, as well as, a variation in resonance frequency even with use of the metal terminals which satisfy the criteria as defined by the formula described later.

Also, regarding the electrode disposed on the upper surface of the piezoelectric ceramic plate, this electrode may be formed by known electrode fabrication techniques.

It should be noted in this preferred embodiment that while no electrodes are disposed on the lower surface of the piezoelectric element 5, it will be possible if required that an electrode is also disposed on the lower surface of piezoelectric element 5 and is adhered to the metal plate 4.

Figure 2:
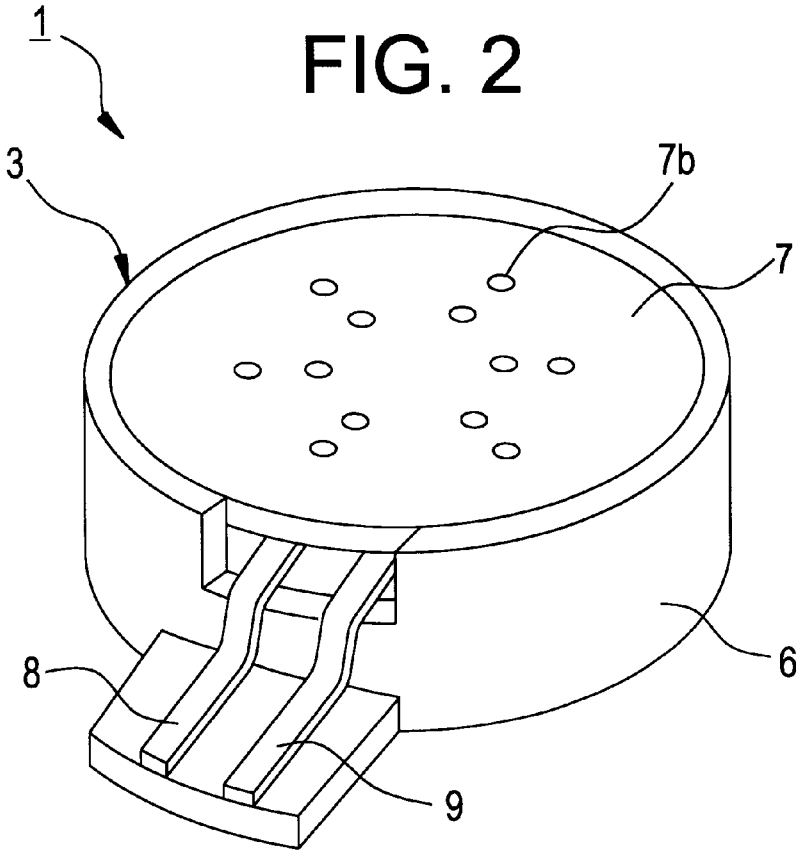
FIG. 2 is a perspective view of the piezoelectric electro-acoustic transducer shown in FIG. 1.

As shown in FIG. 2, the casing 3 preferably has a substantially tubular or cylindrical casing member 6 of a decreased height having an opening at its upper end and a bottom at its lower end, and a lid member 7 which is secured to the casing member 6 so as to block or close an opening 6*a* of the casing member 6.

The casing member 6 and lid member 7 may be made of a chosen dielectric material, such as insulative ceramics, synthesis resin, or other suitable materials.

A step-like portion 6*b* is formed on the inner wall of the casing member 6 at a vertical midpoint position, allowing the piezoelectric diaphragm 2 to be supported at the step-like portion 6*b*. More specifically, the piezoelectric diaphragm 2 is mounted on the step-like portion 6*b* for rigid support of the piezoelectric diaphragm 2 between a downwardly extended ring-like section 7*a* of the lid member 7 and the step-like portion 6*b*.

Note that a cut-away portion 6*c* is formed at part of the circumferential wall of the casing member 6, allowing metal terminals 8, 9 to extend to the outside of the casing member 6. The casing member 6 also has an external terminal-edge support laterally projecting from the outer circumferential wall thereof providing fixed support of two spaced-apart terminal ends of the parallel elongate metal terminals 8, 9 on the upper surface thereof as best illustrated in FIG. 2.

The lid member 7 is also provided with a plurality of through holes 7*b*, which are provided for externally radiating sound waves and for receiving incoming sound waves. Similarly, a plurality of through holes 6*d* are formed in the bottom plane of the casing member 6 for the same reasons.

The metal terminal 8 is disposed in contact with the electrode on the upper surface of the piezoelectric element 5 whereas the metal terminal 9 is disposed in contact with the metal plate 2. The contacts are achieved by use of solder 10*a*, 10*b* in this preferred embodiment; however, the same may alternatively be attained using other possible contact methods and structures including a method of using conductive adhesive in the alternative of the solders, a welding technique, and other suitable contact establishing techniques.

The metal terminal 8 may be made of suitable metals or alloys. A feature of the present preferred embodiment lies in that the metal terminal 8 is specifically arranged in such a manner that the modulus of elasticity X is specifically determined to fall within a range as defined by:

$$\frac{b \times h^3 \times E}{4 \times L^3} \leq 100\ (N/m),$$

where E ($N/m^3$) is the Young's modulus of one metal terminal disposed in contact with a piezoelectric element, b (mm) is the width of a part of the metal terminal extending from the inside of the casing to the outside thereof, h (mm) is the thickness of the metal terminal, and L (mm) is the length of the metal terminal. As a result of the metal terminal 8 being constructed to satisfy the physical relationship described above, even where an attempt is made to achieve significant size and thickness reduction of the casing 3, resultant sound pressure and resonance frequency characteristics will hardly be affected adversely. This will be explained in more detail on the basis of one working experimental example.

In this example, a piezoelectric diaphragm 2 was prepared from a metal plate 4 made of Ni alloy and measuring 19.4 mm in diameter and 0.05 mm in thickness, and a PZT piezoelectric element 5 of 14-mm diameter×0.05-mm thickness as laminated on the upper surface of metal plate 4. In this example, a casing 3 was made of PBT (polybutylene terphthalate) resin and measured 18.8 mm in inner diameter at the positions lower in level than the step-like portion 6*b*, 21.5 mm in outer diameter A of FIG. 1, and 1.8 mm in height. Note that the height position from the bottom plane of the step-like portion 6*b* was 0.8 mm.

Five different types of piezoelectric electro-acoustic transducers were manufactured using the piezoelectric diaphragm 2 and casing 3 having the dimensions as stated supra and also using for the metal terminal 8, several metal terminals A to E shown in the Table below. Additionally, for the metal terminal 9, brass was used.

Figure 3:
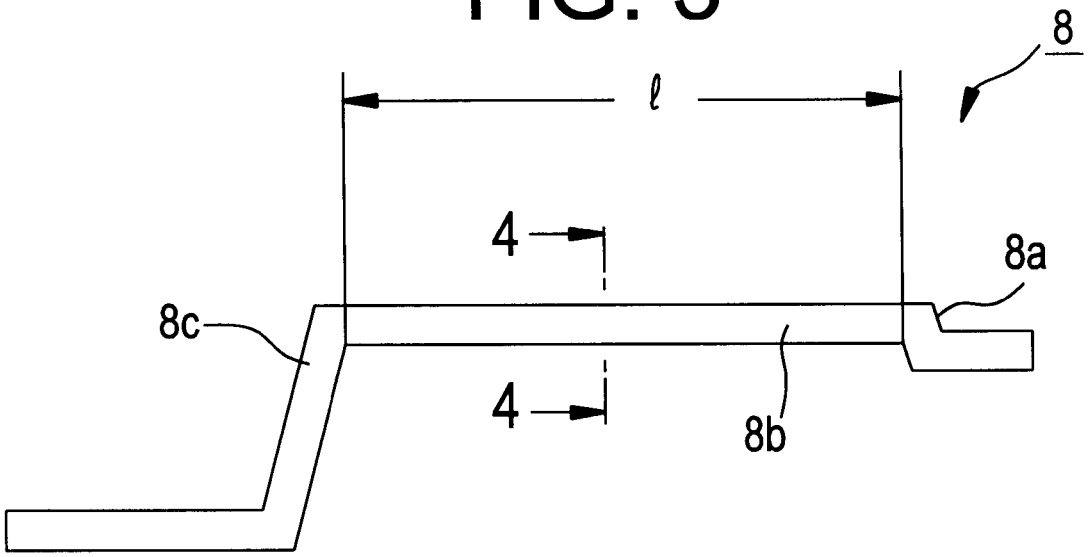
FIG. 3 is a side view of one metal terminal disposed in contact with a piezoelectric element of the transducer.
Figure 4:
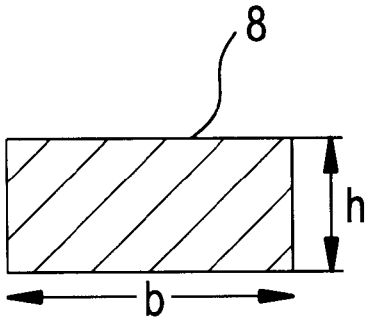
FIG. 4 is a cross-sectional view of the metal terminal taken along line A—A of FIG. 3.

Note that the plate h, width b and length L of the metal terminals in the Table are size dimensions shown in FIGS. 3 and 4. More specifically, the metal terminal 8 preferably has a bent section 8*a* in the vicinity of a certain part to be brought into contact with the piezoelectric element 5, has a linear section 8*b* extending from this bent section 8*a*. to the outside of the casing-3, and has a shape wherein a second bent section 8*c* is formed at an external edge side of the linear section 8*b*. Here, the length L of the metal terminal 8 refers to the length of the linear section 8*b* elongated from the bent section 8*a* toward the outside of the casing 3 as shown in FIG. 3. Also, the plate h and width b refers to the thickness and width dimensions at the linear section 8*b* (see FIG. 4).

TABLE

| Metal Terminal | Plate Thickness h | Width b | Length L | Young's Modulus E | $b \times h^2 \times E$ / $4 \times L^3$ —≦100 |
|---|---|---|---|---|---|
| Sample | | | | | |
| A | 0.10 | 0.10 | 5.0 | 1.03E+11 | 20.60 |
| B | 0.10 | 0.30 | 5.0 | 1.03E+11 | 61.80 |
| C | 0.10 | 0.50 | 5.0 | 1.03E+11 | 103.00 |
| D | 0.15 | 0.30 | 5.0 | 1.03E+11 | 208.58 |
| E | 0.20 | 0.50 | 5.0 | 1.55E+11 | 1240.00 |

As described above, the five different types of piezoelectric electro-acoustic transducers were prepared with the metal terminals A–E used as the metal terminal 8, and then subjected to measurements of sound pressure versus frequency characteristics. The results are shown in FIG. 5 with symbols A–E included therein.

Figure 6:
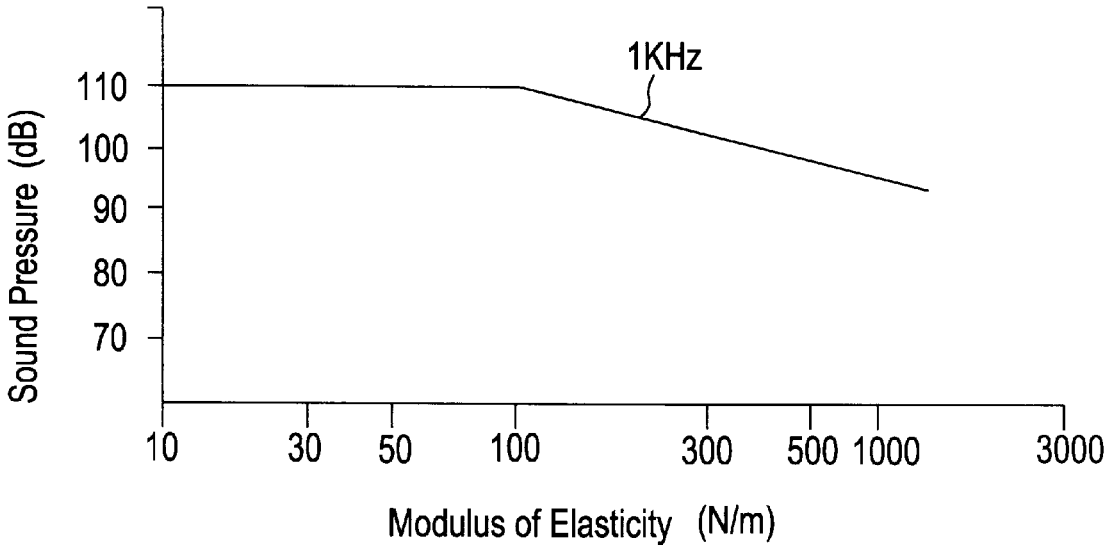
FIG. 6 is a graph showing the correlation of the modulus of elasticity versus sound pressure in the case of 1 kHz.

Also, the relation of the modulus of elasticity versus sound pressure at 1 kHz is shown in FIG. 6. As can be seen from FIG. 6, as the modulus of elasticity increases beyond 100 at 1 kHz, the sound pressure decreases significantly. Therefore, it has been found that it is required that the modulus of elasticity be less than br equal to 100 at 1 kHz in order to eliminate a decrease in sound pressure.

Figure 5:
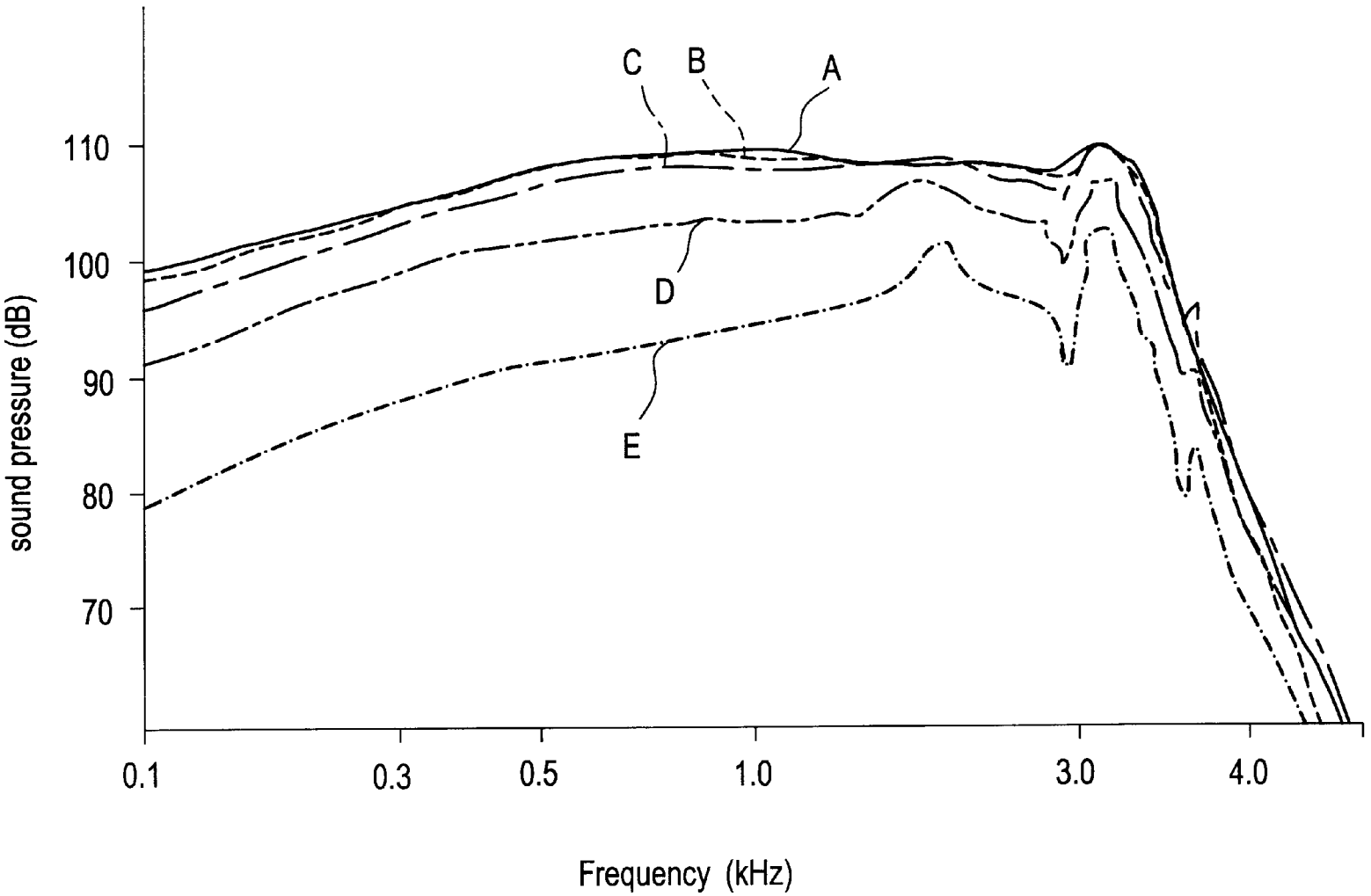
FIG. 5 is a graph showing the sound pressure versus frequency characteristics of several working samples of the piezoelectric electro-acoustic transducer as manufactured using five different types of metal terminals.

On the other hand, it has been apparent from viewing FIG. 5 that where the metal terminals A–B were used, a resultant decrease of sound pressure remains less due to the fact that the modulus of elasticity as defined by the Formula remains less than or equal to 100; on the contrary, in the case of using the metal terminals C–E, since the modulus of elasticity defined by the above Formula is greater than 100, a decrease in sound pressure becomes extreme. In other words, considering by way of example that the frequency is at 1 kHz, it may be seen that where the metal terminal D is used, its resultant sound pressure was reduced by an amount of approximately 5 to 7 dB (4 to 7%); with use of the metal terminal E, the sound pressure decreases by an amount of 15–17 dB (13–16%). Alternatively, the metal terminal C is such that a decrease of sound pressure was observed at low frequency ranges (a decrease of 2–3 dB (2–3%) at 0.1 kHz).

As a consequence, it may be understood from the results shown in FIG. 5 that the use of metal terminals having the modulus of elasticity of not greater than 100 enables achievement of successful elimination of occurrence of any adverse affect on the sound pressure even when employing the thinner casing 3 mentioned previously.

It should be noted that while the preferred embodiment described above was configured to use therein the piezoelectric diaphragm 2 having a ring-like shape, piezoelectric diaphragm of other shapes may alternatively be used such as those having a substantially rectangular shape; it is also pointed out that the planar shape of the casing 3 may be freely modified in conformity with the planar shape of the piezoelectric diaphragm when necessary.

It has been described that with the piezoelectric electro-acoustic transducer in accordance with the preferred embodiments of the present invention, since specific metal terminals having the modulus of elasticity of less than or equal to 100 are in contact with the piezoelectric element, even where an attempt is made to achieve substantial reduction in size and thickness of the casing 3, resultant sound pressure and resonance frequency characteristics will hardly be affected adversely as compared with the prior art piezoelectric electro-acoustic transducers. It is thus possible to easily obtain a piezoelectric electro-acoustic transducer with any intended characteristics.

Consequently, according to the preferred embodiments of the present invention, it becomes possible to further facilitate a reduction in thickness and size of piezoelectric sounders and piezoelectric telephone receivers.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A piezoelectric electro-acoustic transducer comprising:

a piezoelectric diaphragm including a piezoelectric ceramic plate and a metallic plate, said piezoelectric diaphragm having an electrode disposed on a surface opposite to at least said metallic plate and a first metal terminal being in contact with said metallic plate and a second metal terminal contacted with said electrode, said second metal terminal including a first bent portion and a second bent portion; and a casing storing therein said piezoelectric diaphragm; wherein said second metal terminal has a modulus of elasticity X within a range as defined by:

$$\frac{b \times h^3 \times E}{4 \times L^3} \leq 100\ (N/m)$$

where E ($N/m^3$) is the Young's modulus of said second metal terminal, b (mm) is a width of a portion of said second metal terminal located between a first bent portion located inside of said casing, and a second bent portion located outside of said casing, h (mm) is a thickness of said portion of said second metal terminal, and L (mm) is a length of said portion of said second metal terminal.

2. The transducer according to claim 1, wherein said second metal terminal has a modulus of elasticity less than or equal to 100.

3. The transducer according to claim 1, wherein said ceramic plate has a thickness of about 100 $\mu$m or less and said metallic plate has a thickness of about 100 $\mu$m or less.

4. The transducer according to claim 1, wherein said casing has a substantially cylindrical shape.

5. The transducer according to claim 1, wherein said metallic plate and said piezoelectric plate have a disk shape.

6. The transducer according to claim 1, wherein said portion of said second metal terminal has a substantially rectangular cross-sectional shape.

7. The transducer according to claim 1, wherein said casing has an opening allowing the first and second metal terminals to penetrate therethrough to an outside of said housing, and an external support on an outer circumferential wall of said casing arranged to support spaced-apart terminal ends of said first and second metal terminals thereon.

8. The transducer according to claim 1, wherein said casing has an inner wall and a step-like portion mounting said metallic plate thereon at a periphery thereof.

9. The transducer according to claim 1, wherein said housing is made of an insulative material.

10. An electro-acoustic transducer device comprising:

a housing;

a diaphragm in said housing, said diaphragm including a metallic plate having a first surface and a second surface, and a piezoelectric plate on the first surface of said metallic plate, said piezoelectric plate having a surface opposing said first surface and having a diameter less than a diameter of said metallic plate so as to define an exposed periphery on said first surface of said metallic plate;

a first conductive lead electrically coupled to said metallic plate at the exposed periphery of said metallic plate; and a second conductive lead electrically coupled to said piezoelectric plate and having a first bent portion located inside of said housing and a second bent portion located outside of said housing, the second conductive lead having a modulus of elasticity less than or equal to 100 and the modulus of elaslicity of said second conductive lead is within a range of:

$$\frac{b \times h^3 \times E}{4 \times L^3} \leq 100\ (N/m)$$

where E ($N/m^3$) is the Young's modulus of said second metal terminal, b (mm) is a width of a portion of said second metal terminal located between said first bent portion located inside of said housing and said second bent portion located outside of said housing, h (mm) is a thickness of said portion of said second metal terminal, and L (mm) is a length of said portion of said second metal terminal.

11. The device according to claim 10, wherein said housing is made of an insulative material.

12. The device according to claim 10, wherein said piezoelectric plate comprises a ceramic plate having a thickness of about 100 $\mu$m or less and said metallic plate has a thickness of about 100 $\mu$m or less.

13. The device according to claim 10, wherein said housing has a substantially cylindrical shape.

14. The device according to claim 10, wherein said metallic plate and said piezoelectric plate have a disk shape.

15. The device according to claim 10, wherein said portion of said second lead has a substantially rectangular cross-sectional shape.

16. The device according to claim 10, wherein said housing has an opening allowing the first and second leads to penetrate therethrough to an outside of said housing, and an external support on an outer circumferential wall of said housing arranged to support spaced-apart terminal ends of said first and second leads thereon.

17. The device according to claim 10, wherein said housing has an inner wall and a step-like portion mounting said metallic plate thereon at a periphery thereof.

* * * * *